US011598529B2

(12) United States Patent
Gigante et al.

(10) Patent No.: US 11,598,529 B2
(45) Date of Patent: Mar. 7, 2023

(54) OVEN BURNER COVER SCREEN WITH IMPROVED MESH CONFIGURATION

(71) Applicant: WHIRLPOOL CORPORATION, Benton Harbor, MI (US)

(72) Inventors: Alessandro Gigante, Comerio (IT); Dhiraj Jambuvant Gotekar, Maharashtra (IN); Kedar Kulkarni, Maharashtra (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 1017 days.

(21) Appl. No.: 16/292,739

(22) Filed: Mar. 5, 2019

(65) Prior Publication Data

US 2020/0284438 A1 Sep. 10, 2020

(51) Int. Cl.

| | |
|---|---|
| ***F24C 7/04*** | (2021.01) |
| ***F24C 15/16*** | (2006.01) |
| ***H05B 6/76*** | (2006.01) |

(52) U.S. Cl.

CPC ..... *F24C 7/043* (2013.01); *F24C 15/16* (2013.01); *H05B 6/766* (2013.01)

(58) Field of Classification Search

CPC ..... H05B 6/766; F24C 15/007; F24C 15/08; F24C 15/16; F24C 15/18; F24C 15/22; F24C 15/32; F24C 15/325; F24C 7/043; F24C 7/046; F24C 7/06; F24C 7/065; F24C 7/067; F24C 7/087

USPC ..... 219/391, 395, 399, 402, 405, 406, 408, 219/411

See application file for complete search history.

(56) References Cited

U.S. PATENT DOCUMENTS

| | | | | |
|---|---|---|---|---|
| 3,036,194 | A | 5/1962 | Deininger | |
| 3,947,658 | A | 3/1976 | Sato et al. | |
| 5,786,569 | A * | 7/1998 | Westerberg | F24C 7/06 219/411 |
| 7,342,203 | B2 | 3/2008 | Benoit et al. | |
| 8,258,435 | B2 | 9/2012 | Bonuso et al. | |
| 9,012,815 | B2 * | 4/2015 | Cha | F24C 15/18 219/411 |
| 9,404,661 | B2 * | 8/2016 | Kim | F24C 15/007 |
| 2007/0108179 | A1 | 5/2007 | Hines | |

(Continued)

FOREIGN PATENT DOCUMENTS

| | | |
|---|---|---|
| CA | 1254254 A | 5/1989 |
| EP | 298567 A1 | 1/1989 |
| EP | 0495394 A2 | 7/1992 |

(Continued)

*Primary Examiner* — Hung D Nguyen

(74) *Attorney, Agent, or Firm* — Price Heneveld LLP

(57) ABSTRACT

A heating arrangement for an oven includes a heating assembly including a plurality of elongate heating members extending along respective longitudinal axes oriented in a first direction and mutually spaced apart in a second direction perpendicular to the first direction. The heating arrangement further includes a cover unit having a body extending along a plane oriented parallel with the plurality of elongate heating members and spaced apart therefrom in a third direction perpendicular to the first and second directions. A plurality of openings extend through the body with at least some of the openings being aligned with respective ones of the elongate heating members in the first and second directions.

13 Claims, 9 Drawing Sheets

(56) References Cited

U.S. PATENT DOCUMENTS

| | | | |
|---|---|---|---|
| 2013/0284161 | A1 | 10/2013 | Johnson |
| 2016/0327276 | A1 | 11/2016 | Lee |

FOREIGN PATENT DOCUMENTS

| | | | |
|---|---|---|---|
| KR | 2006082253 | A | 7/2006 |
| KR | 100618229 | B1 | 9/2006 |

* cited by examiner

OVEN BURNER COVER SCREEN WITH IMPROVED MESH CONFIGURATION

BACKGROUND

The present device generally relates to a heating arrangement for use in an oven, and more specifically, to a heating arrangement useable as a broiler in a conventional oven and having a cover mesh arranged for use with quartz heating elements.

Quartz heating tubes or other infrared heating elements are useable in cooking appliances for heating cooking cavities. Generally, such heating elements rely on dissipation of infrared radiation from the heating element into the cooking cavity, which requires a line of sight for dissipation of energy, including by flux of the radiating energy. Notably, such heating does not require a medium, such as air, or contact with the item to be heated, making them efficiently useable as broiler elements positioned on the upper portion of a heating cavity (or as toaster elements). When used in ovens and the like, a mesh cover may be positioned between the heating tubes and the oven cavity to prevent a user from touching any of the heating elements. In such smaller appliances, a mesh material is used with openings spaced between the tubes such that no direct line of sight is present between a heating tube and the oven cavity. In this respect, a reflector may be provided opposite the mesh and may reflect infrared energy internally to promote flux through the openings in the mesh. When broilers of this type are used in connection with combination microwave ovens and smaller cooking appliances, reflectors with a high reflective index can be used at a reasonable cost and with low reinforcement or deformation concerns, due to the smaller size. Quartz and other infrared heating elements are also generally useable in connection with broiler units in larger appliances, however, constraints on the types of reflectors useable in such large configurations, for example, may make it advantageous to use different mesh configurations.

SUMMARY

In at least one aspect, a heating arrangement for an oven includes a heating assembly including a plurality of elongate heating members extending along respective longitudinal axes oriented in a first direction and mutually spaced apart in a second direction perpendicular to the first direction. The heating arrangement further includes a cover unit having a body extending along a plane oriented parallel with the plurality of elongate heating members and spaced apart therefrom in a third direction perpendicular to the first and second directions. A plurality of openings extend through the body with at least some of the openings being aligned with respective ones of the elongate heating members in the first and second directions.

In at least another aspect, an oven includes a cabinet defining an interior cooking cavity and a heating arrangement mounted within the interior cavity adjacent an upper surface thereof. The heating arrangement, includes a heating assembly having a plurality of elongate heating members extending along respective longitudinal axes oriented in a first direction and having a width in a second direction perpendicular to the first direction. The heating assembly also includes a cover unit having a body extending along a plane oriented parallel with upper surface of the cavity and spaced apart therefrom in a third direction with the heating members positioned between the upper surface and the cover unit. A plurality of openings extend through the body with at least some of the openings being aligned with respective ones of the elongate heating members in the first and second directions. The plurality of openings define respective lateral axes and longitudinal axes longer than the lateral axes. The longitudinal axes of the plurality of openings extend in the second direction.

In at least another aspect, an oven includes a cabinet defining an interior cooking cavity and a heating arrangement mounted within the interior cavity adjacent an upper surface thereof. The heating arrangement includes a heating assembly having a plurality of elongate heating members extending along respective longitudinal axes oriented in a first direction and having a width in a second direction perpendicular to the first direction. The heating assembly further includes a cover unit having a body extending along a plane oriented parallel with upper surface of the cavity and spaced apart therefrom in a third direction with the heating members positioned between the upper surface and the cover unit. A plurality of openings extend through the body with at least some of the openings being aligned with respective ones of the elongate heating members in the first and second directions. The plurality of openings define respective lateral axes and longitudinal axes longer than the lateral axes. The longitudinal axes of the plurality of openings extend in the first direction, and the lengths of the openings extend through substantially an entire depth of the cover in the second direction.

These and other features, advantages, and objects of the present device will be further understood and appreciated by those skilled in the art upon studying the following specification, claims, and appended drawings.

DETAILED DESCRIPTION OF EMBODIMENTS

Figure 1:
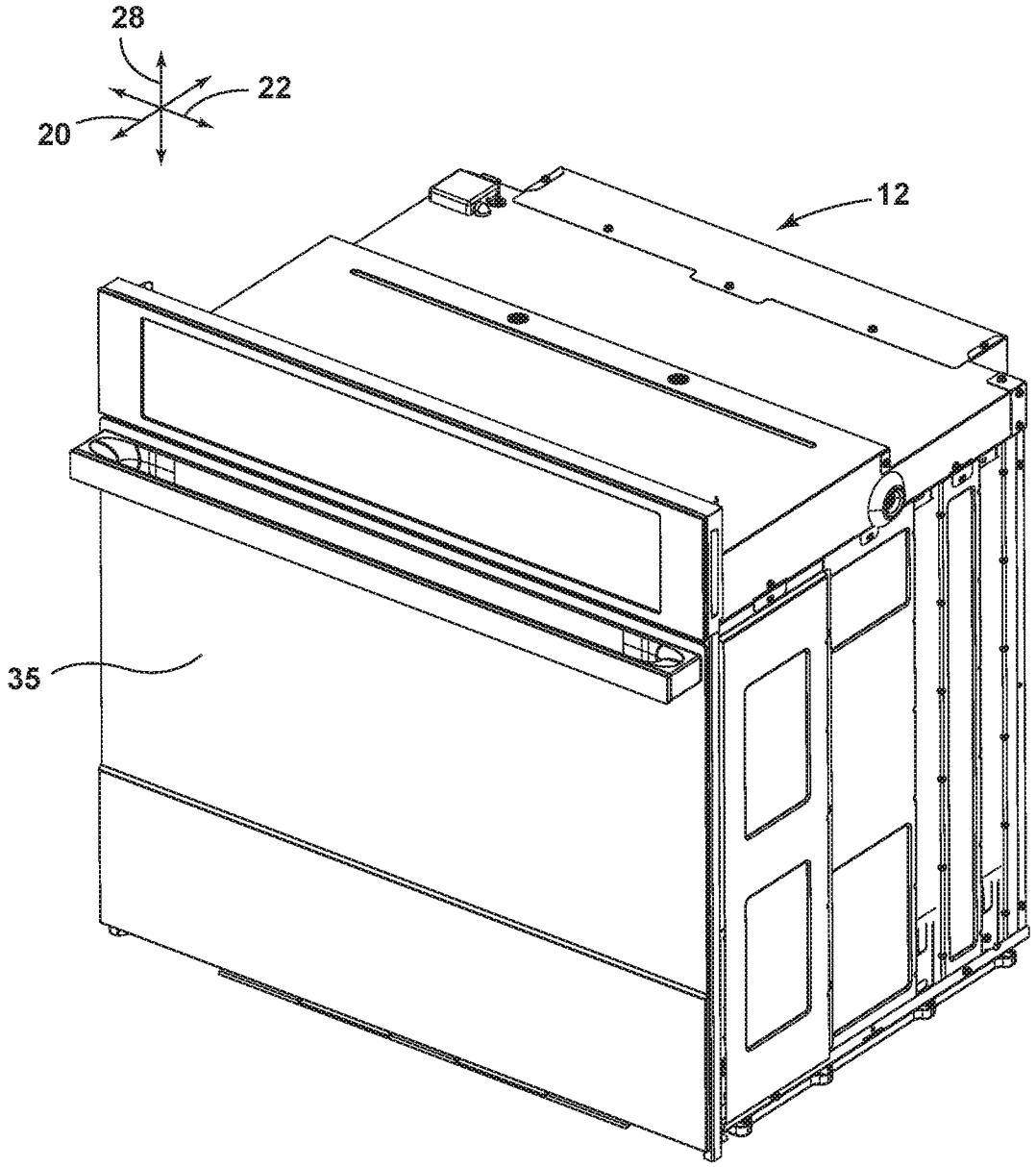
FIG. 1 is a front perspective of an oven including a heating arrangement according to an aspect of the disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary.

It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1-7, reference numeral 10 generally designates a heating arrangement for an oven 12. The heating arrangement 10 includes a heating assembly 14 that includes a plurality of elongate heating members 16 extending along respective longitudinal axes 18 oriented in a first direction, which according to the depiction in the figures is a second direction corresponding with the depicted front-to-back or "depth" direction 20 of the oven 12. The heating members 16 are spaced across a corresponding width direction 22 of the oven 12. The arrangement 10 further includes a cover unit 24 having a planar body 26 oriented parallel with the plurality of elongate heating members 16 (i.e., with respect to the individual, spaced-apart longitudinal axes 18 of the heating members 16) and spaced apart therefrom in a third, height direction 28. A plurality of openings 30 extend through the body 26 of the cover unit 24 with at least some of the openings 30 being aligned with respective ones of the elongate heating members 16 in the depth direction 20 and the width direction 22 (i.e., in a view at the cover unit 24 along the height direction 28).

As discussed herein, the present incorporation of the openings 30 into the body 26 of the cover unit 24 provides a resulting structure useable as a protective mesh for the heating assembly 14. In particular, such mesh structures can be used in connection with a variation of the oven 12 that utilizes quartz heating tubes for the heating members 16, particularly when the heating assembly 14 is a broiler heater in an otherwise conventional oven. As discussed above, quartz heating elements are used in smaller countertop ovens or in combination microwave ovens in connection with a protective mesh. In connection with larger appliances, such as the depicted conventional oven 12 and further including commercial ovens and the like (which are generally larger and utilize both higher voltage and amperage (e.g., 110 V, 15 Amp countertop ovens, compared to 220 V, 30 Amp conventional ovens)), less reflective materials may be used for the reflector plate 40 to be able to provide sufficient structural rigidity and manage cost, given the size of cavity 34 and the operating conditions of such ovens. The use of such material may reduce the ability of heat to reach the oven cavity through a mesh of a pattern or configuration similar to those used with higher-index reflectors, which particularly use openings that are not aligned with the quartz tubes. In this manner, the present cover unit 24 includes openings 30 that, as mentioned above, are aligned with the heating members 16 in the depth direction 20 and the width direction 22. Put differently, the openings can be described as being aligned with the heating members 16 along the third direction 28 is such that, in one example, a theoretical line extending along the third direction 28 (i.e., vertically in the depiction of FIG. 1) through such an opening 30 would also intersect one of the heating members 16. Alternatively, it may be said that one of the openings 30 is aligned with one of the heating members 16 when such heating member 16 is visible through the opening 30 when viewed along the third direction 28 (i.e., when the viewing plane is normal to the third direction 28). To provide comparable protection from both damage to the heating members 16 and to the user, the openings 30 may be sized to prevent a user or other object from contacting the heating members 16 through the openings 30. It is noted that the cover unit 24 described herein can be useable in other types of heating assemblies 14 that use different types of heating members 16 for comparable protective purposes.

Figure 2:
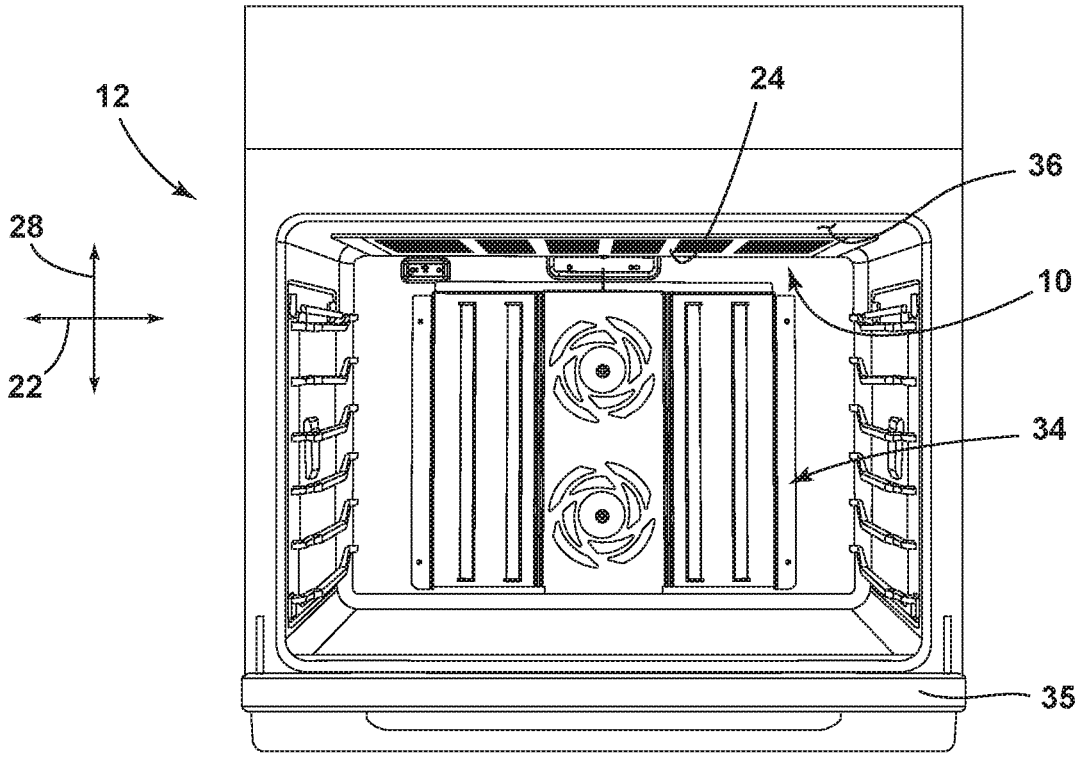
FIG. 2 is a front view of an interior cooking cavity of the oven of FIG. 1.
Figure 3:
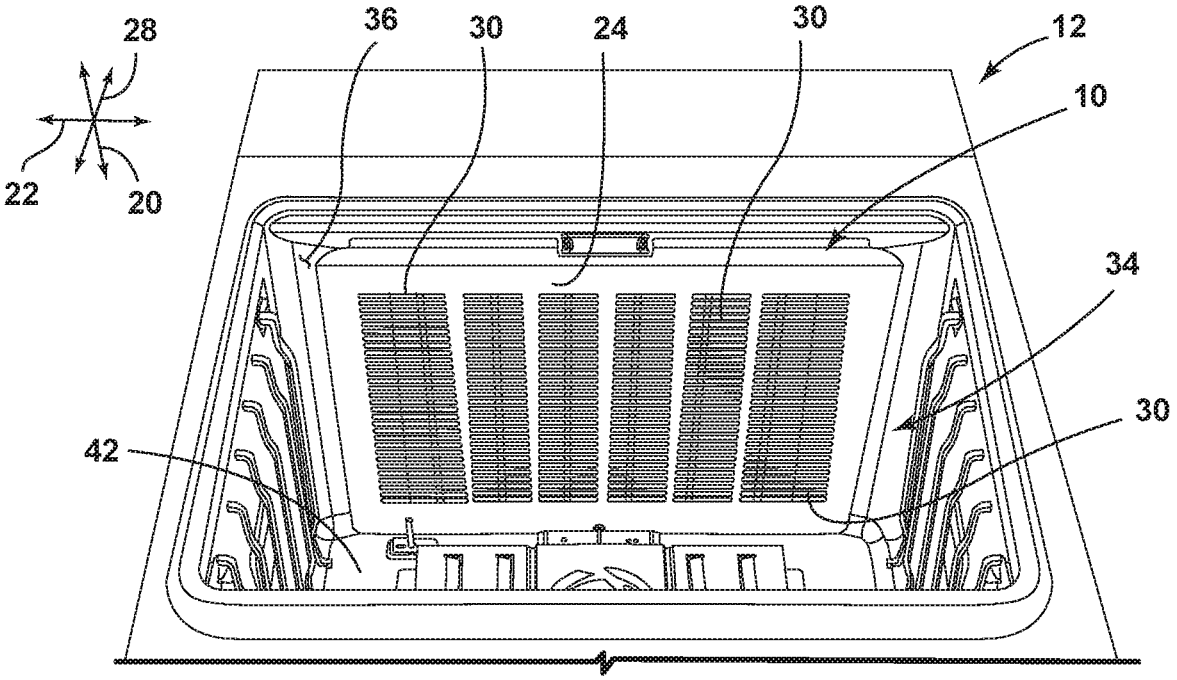
FIG. 3 is a bottom-front perspective view of the oven cavity showing a broiler heating assembly thereof.

As shown in FIGS. 1 and 2, the oven 12 associated with the present heating arrangement 10 may include a cabinet 32 defining an interior cooking cavity 34 accessible through a door 35 selectively enclosing the cavity 34. The heating arrangement 10 is mounted within the interior cavity 34 adjacent an upper surface 38 thereof in the typical location for the broiler unit according to the described implementation of heating arrangement 10. In various examples, the oven 10 can include additional heating assemblies including one for general heating, which can be in the form of resistive heating elements, gas burners or the like. In the depicted arrangement, the cover unit 24 is configured to be positioned with the body 26 thereof oriented generally parallel with the upper surface 38 of the cavity 34 and spaced apart therefrom in the height direction 28.

Figure 4:
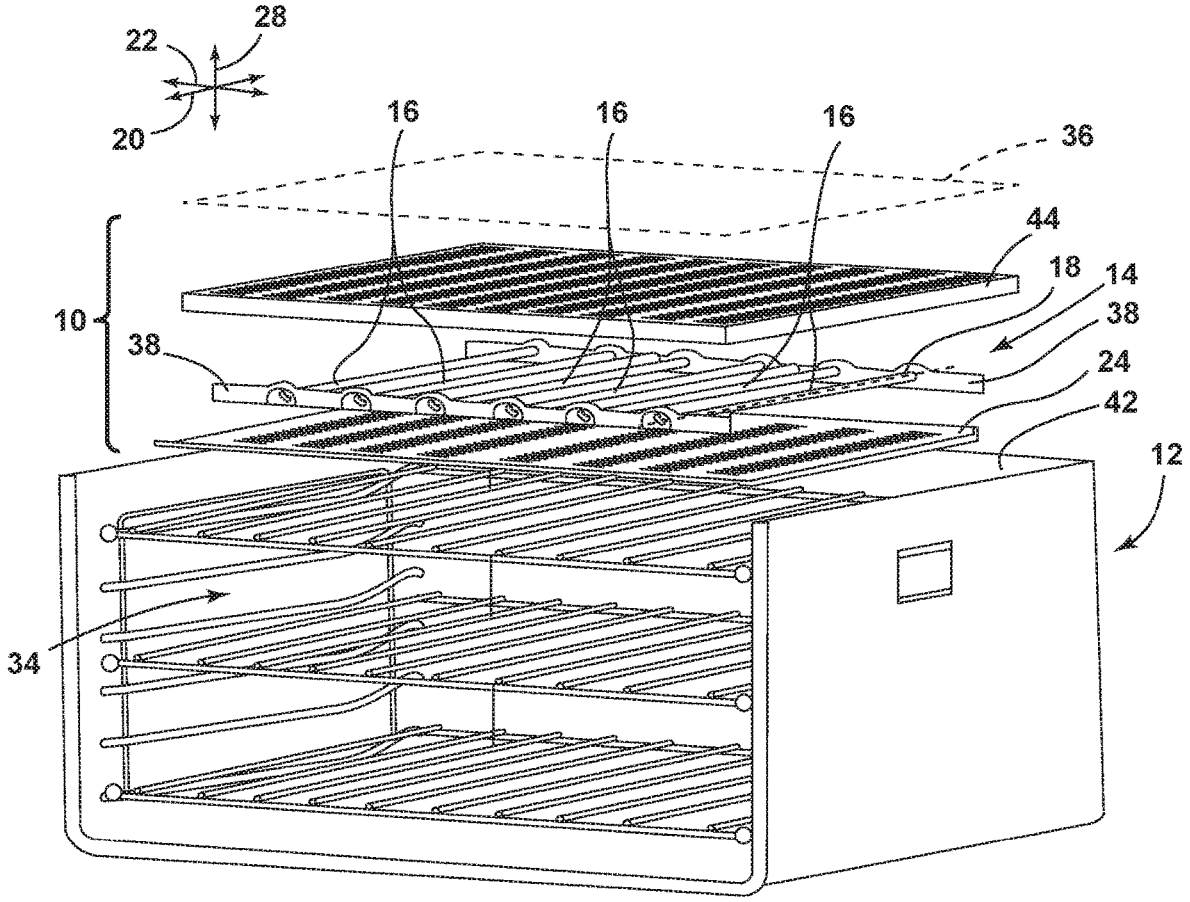
FIG. 4 is an assembly view of the heating arrangement within a portion of the oven cavity.
Figure 5:
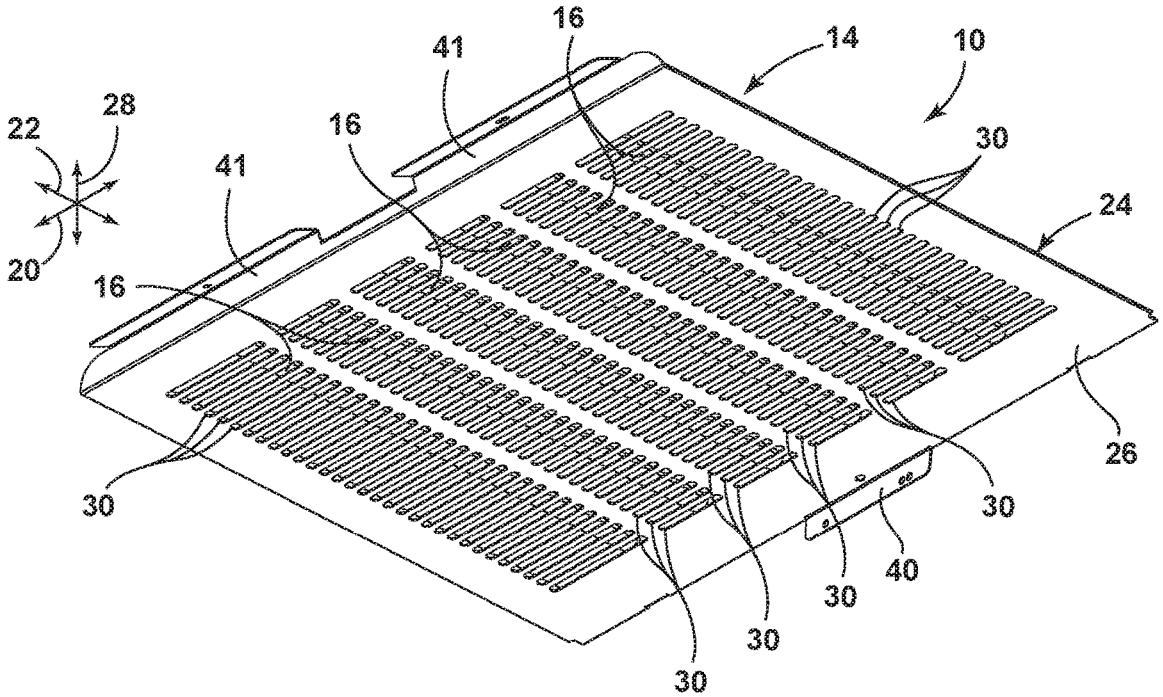
FIG. 5 is a bottom perspective view of a portion of the heating assembly, including a cover unit thereof.
Figure 6:
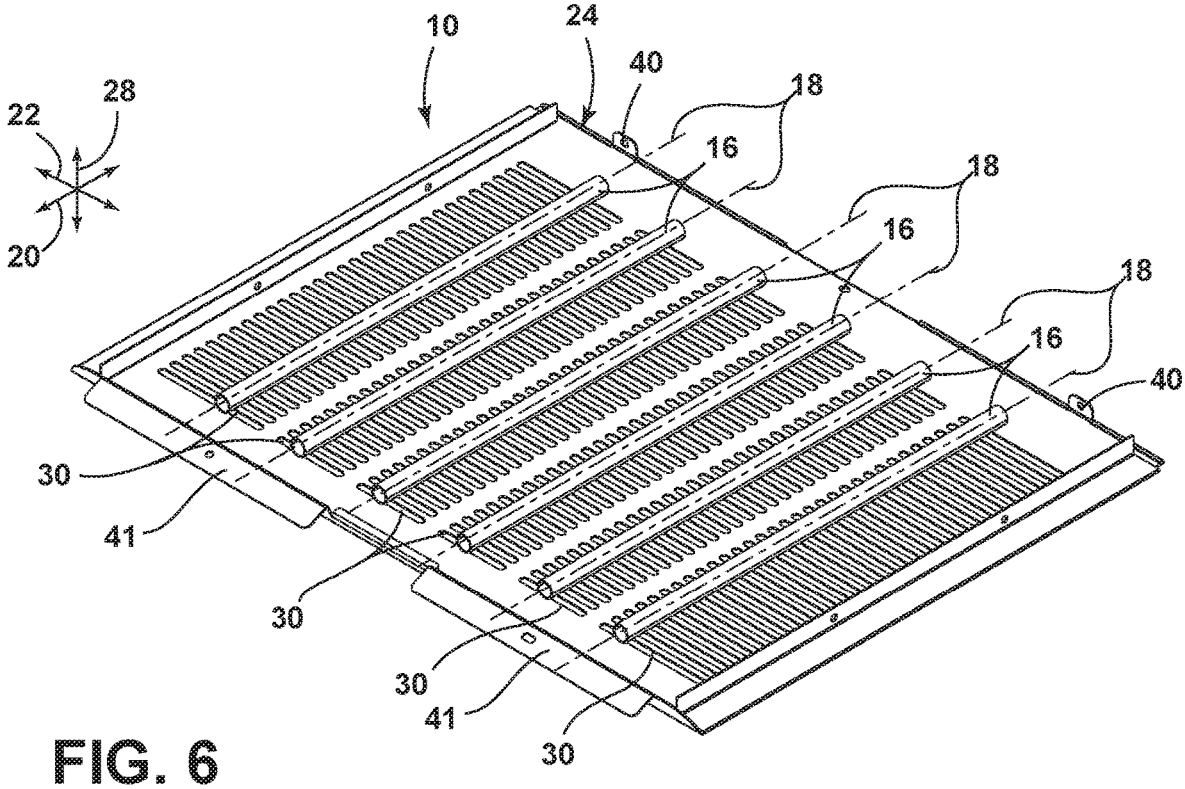
FIG. 6 is a top perspective view of the portion of the heating assembly.

As further shown in FIG. 4, the heating assembly 14 is positioned between the upper surface 38 of the cavity 34 and the cover unit 24. The illustrated spacing of the heating assembly 14, including the heating members 16, between the upper surface 38 and the body 26 of the cover unit 24 can be maintained by additional structure of both the heating assembly 16 and the cover unit 24. In particular, in the illustrated heating assembly 14 incorporating quartz tubes for heating members 16, the heating assembly 14 can include separate front and back support units 38 that can support the heating members 16 on opposite ends thereof to establish and maintain the desired positioning and relative spacing of the heating members 16. In this respect, the elongate heating members 16 in the form of the above-mentioned quartz tubes can be joined together both mechanically and electrically, while still being considered individual or discrete, as they remain physically distinct quartz tube elements. In other examples, the heating assembly can include a heating coil (of a single bent quartz element or a resistive heating element) such that the elongate heating members 16 can be considered the portions of such a coil that are straight end extend in an elongate manner in a single direction (e.g., along the depth direction 20) between the bent portions. Accordingly, in connection with such an alternative heating element, the openings 30 can be aligned with the elongate members 16 individually. In the illustrated example of the heating assembly 14, the support units 38 can be of metal, such as aluminum, steel, or the like with sufficient heat resistance to retain the heating members 16. In one respect, an additional insulating insert can be positioned between the support units 38 and the respective heating members 16 at the interface therebetween. The support units 38 can also retain and conceal the wiring or other electronic circuitry associated with the heating members 16 and providing electrical power thereto. The supporting units can contribute to the assembly of heating members 16 into the depicted heating assembly 14, as well as the ability to mount heating assembly 14 in the cavity 34 of oven 12. In particular, support units 38 can be configured to be assembled with upper surface 36 of cavity 34 (such as by including holes, slots, or the like to correspond with anchors or the like affixed with the upper surface 36 of cavity 34). In a similar manner, cover unit 24 can be configured to be retained in its desired position by affixing with one or both of upper surface 36 of cavity 34 or with support units 38 of heating assembly 14. As illustrated in FIGS. 5 and 6, cover unit 24 can include various flanges 40 or other extensions 41 extending with and, optionally, integral with body 26. In the illustrated example, the extensions 40 can be configured to attach with upper surface 36 of cavity 34 by welding or using bolts, rivets or other mechanical fasteners, including by assembly with preconfigured holes therein. The extensions 41 can have respective ends spaced from body 26 at the desires spacing of body 26 relative to upper surface 36, including to receive heating assembly 14 therebetween. Similarly, the depicted flange 40 can affix with a rear wall 42 at a desired location therealong to similarly space body 26 in the desired location relative to upper surface 36. In this manner, support units 38 can be sized to support heating members 16 at a desired distance from upper surface 36.

The arrangement 10 can further include a reflector plate 44 that can be assembled with and can extend along upper surface 36 opposite the body 26 of cover unit 24 with respect to heating members 16. The reflector plate 44 may be of various reflective materials suitable for the size of oven cavity 34 and can be supported in multiple central locations on upper surface 36. Reflector plate can be textured or otherwise incorporate facets or features to direct the infrared radiation from the heating members 16 that is otherwise directed toward upper surface 36 toward the body 26 of cover unit 24 and, more particularly, through openings 30. In this manner, the particular configuration of reflector plate 44 can vary with the particular position of the heating members 16 and the openings 30, as described further herein.

Figure 7:
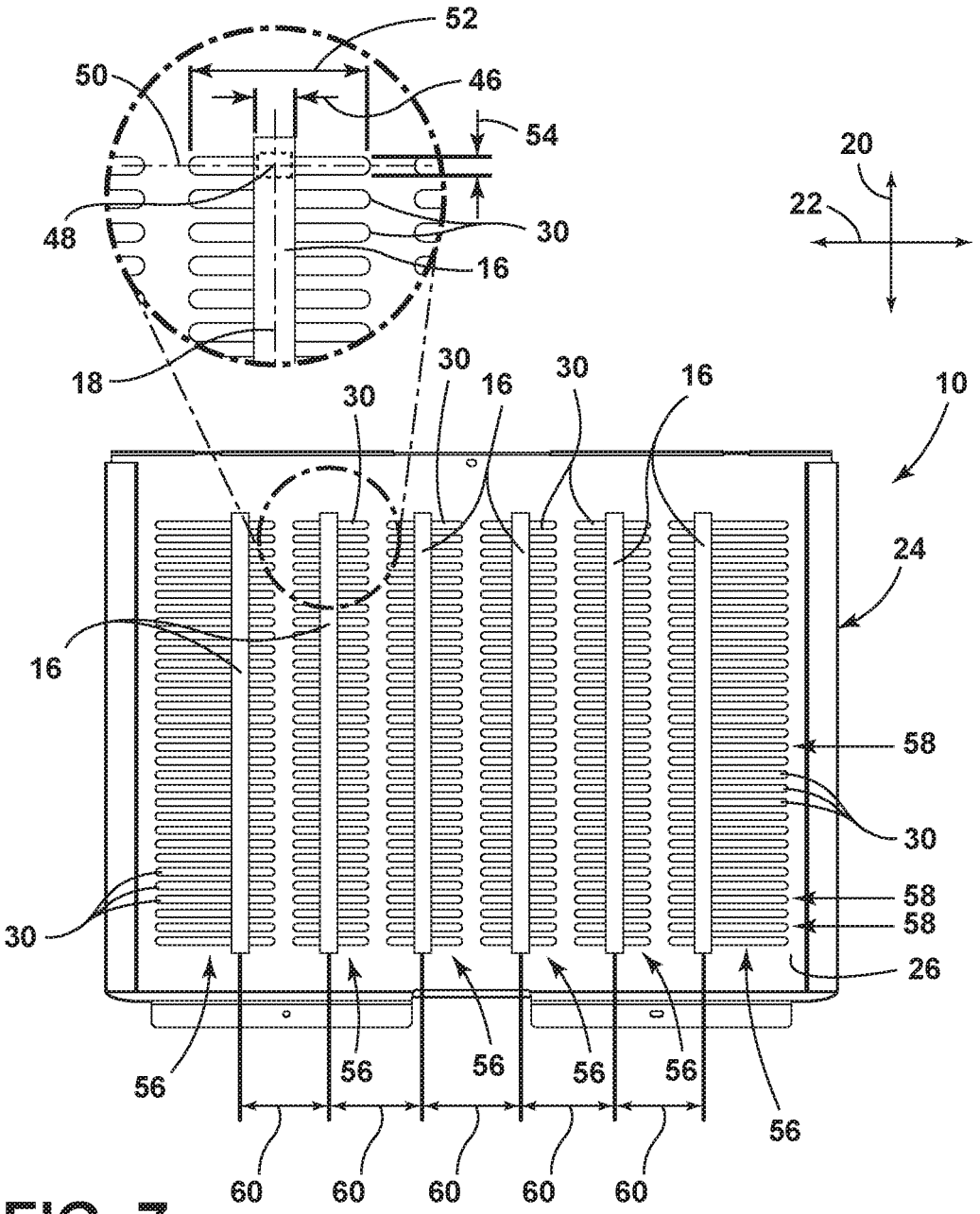
FIG. 7 is a top plan view of the portion of the heating assembly.

As particularly shown in FIGS. 6 and 7, the plurality of elongate heating members 16 each have a respective width 46 transverse to the longitudinal axes 18 thereof. In the illustrated example, the heating members 16 are positioned such that the widths 46 extend in the width direction 22 with respect to oven 12, although other configurations and arrangements are possible. In one aspect, the widths 46 of the heating members 16 can be the same such that the heating members 16 are generally uniform in configuration to provide even heating across the width 22 of cavity 34. As further shown, the plurality of openings 30 each define respective lateral axes 48 and longitudinal axes 50 with the openings 30 having lengths 52 along the longitudinal axes 50 that are greater than widths 54 of the openings 30 along the lateral axes 48. More particularly, each of the openings 30 has a respective length 52 that is greater than the widths 46 of the heating members 16, although in various implementations, the individual lengths 52 of the openings 30 may vary among the various openings 30, including with the locations thereof along body 26, as discussed further below.

Continuing with respect to FIGS. 5-7, the cover unit 24 may be configured such that the longitudinal axes 50 of the plurality of openings 30 all extend in the width direction 22 of oven 12 and, more specifically, with the longitudinal axes 50 extending transverse to the long axes 18 of the heating members 16. As further illustrated, the openings 30 can be arranged in columns 56 extending along the depth direction 20 and with the lateral axes 48 of the openings 30 oriented in the depth direction 20. As shown, in one example all of the openings 30 can be aligned with respective ones of the elongate heating members 16 such that each of the columns 56 corresponds with a particular heating member 16 that is aligned with the openings 30 in such column 56.

In a similar manner, the openings 30 (regardless of whether or not they are aligned with one of the heating members 16 in a particular implementation) are further arranged in respective rows 58 with the longitudinal axes 50 of the openings 30 aligned in the width direction 22 in such rows 58. In particular, the openings 30 are separated in the width direction 22 by solid portions of the body 26 that are positioned between adjacent ones of the plurality of the elongate heating members 16. Such arrangement helps to provide body 26 with sufficient support and structural integrity, particularly of openings 30 such that cover unit 24 does not deform such that openings 30 become too large to provide adequate protection both from and for heating members 16 or too small to allow flux of infrared radiation therethrough. In a particular example, the openings 30 can have widths 54 that are less than the general size of a human finger so as to prevent contact with the heating members 16 through the openings 30, and can have lengths 52 sufficient to allow flux outwardly from the heating members 16 for heating of cavity 34 at a desired rate or efficiency and with a desired distribution. In one example, a cover unit 24 configured according to the principles described herein may provide improved distribution of heat within cavity 34 by at least 3% or greater and an improvement of flux by at least about 25% compared with a cover unit 24 of similar material and material properties with the solid portions of cover unit 24 aligned with the associated heating members 16.

Figure 8:
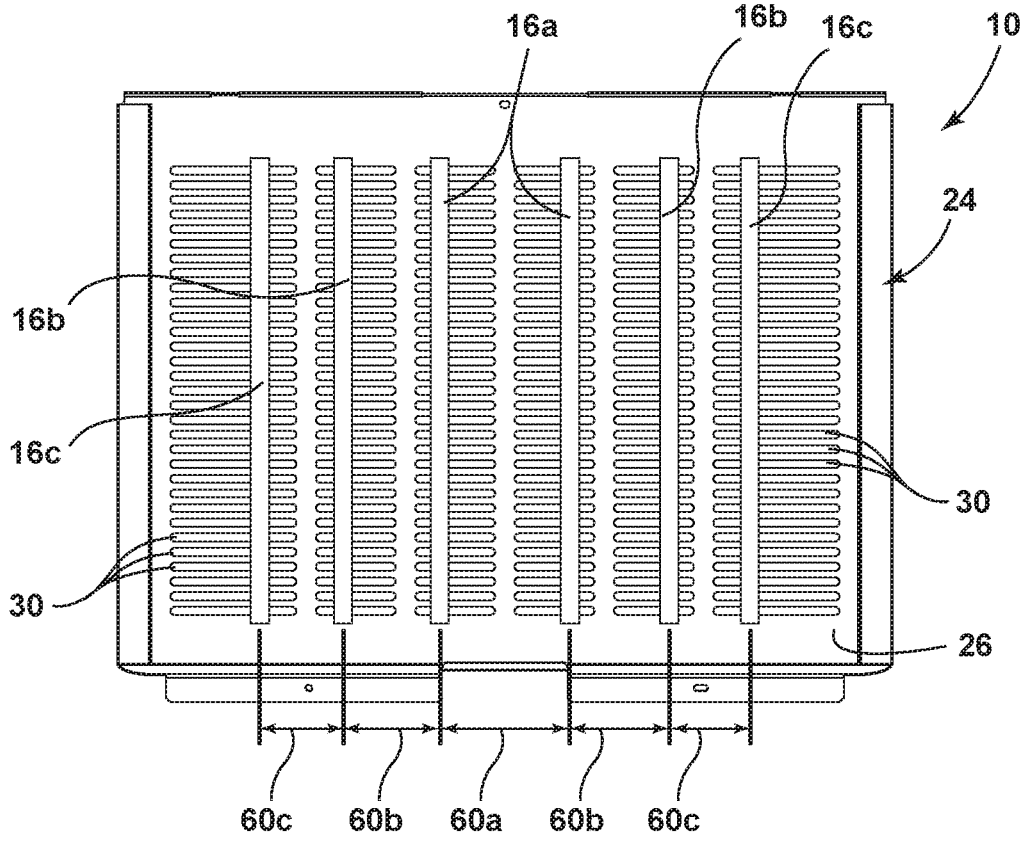
FIG. 8 is a top plan view of a variation of the heating assembly.

As further shown in FIG. 7, the heating members 16 can be evenly-spaced across the width 22 of oven 12 with the respective distances 60 between adjacent heating members 16 being substantially equal. In one example, the distances 60 may be the same and may all be between about 65 mm and 75 mm or, in a particular example, about 70 mm. In an alternative implementation, shown in FIG. 8, the distances 60 may vary across the width 22 of oven with the two center-most heating members **16*a* having a mutual spacing 60*a* of about 74 mm. The distances 60 can decrease moving outwardly from such heating members 16 with the next heating members 16*b* adjacent heating members 16*a* being spaced therefrom by about 71 mm. The outer-most heating members 16*c* can be spaced from heating members 16*b* by about 67 mm. Other examples with varying spacing according to similar concepts may also be possible. In some aspects, such variable spacing can further improve distribution and flux of the infrared radiation from heating members 16 into and with cavity 34**.

Figure 9:
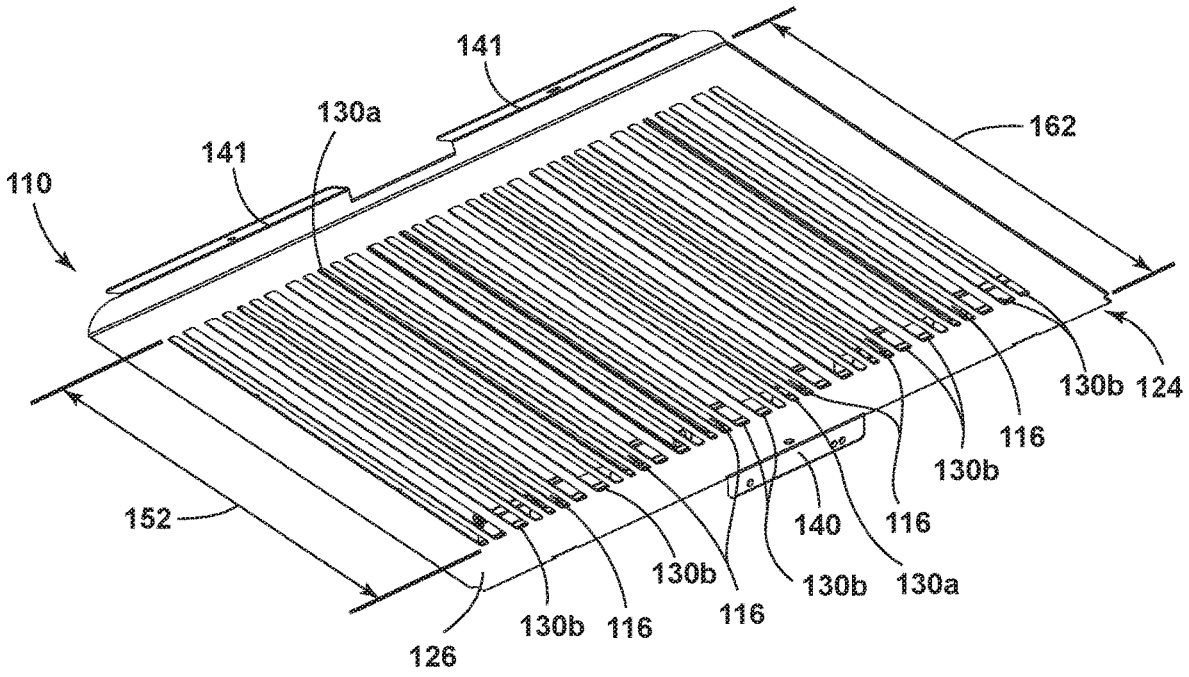
FIG. 9 is a bottom perspective view of a portion of an alternate heating assembly having a different cover unit configuration.
Figure 10:
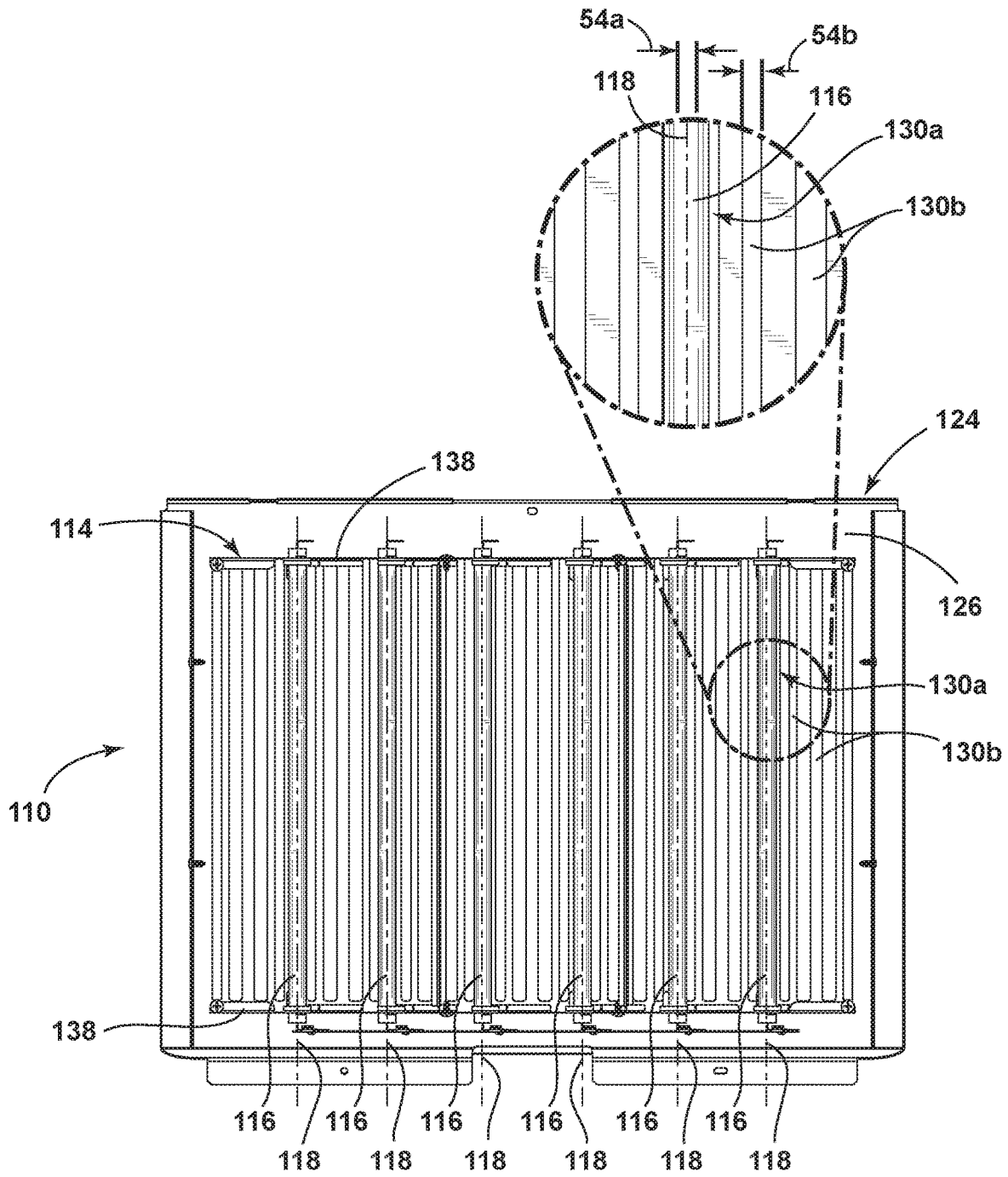
FIG. 10 is a top plan view of the alternative heating assembly.
Figure 11:
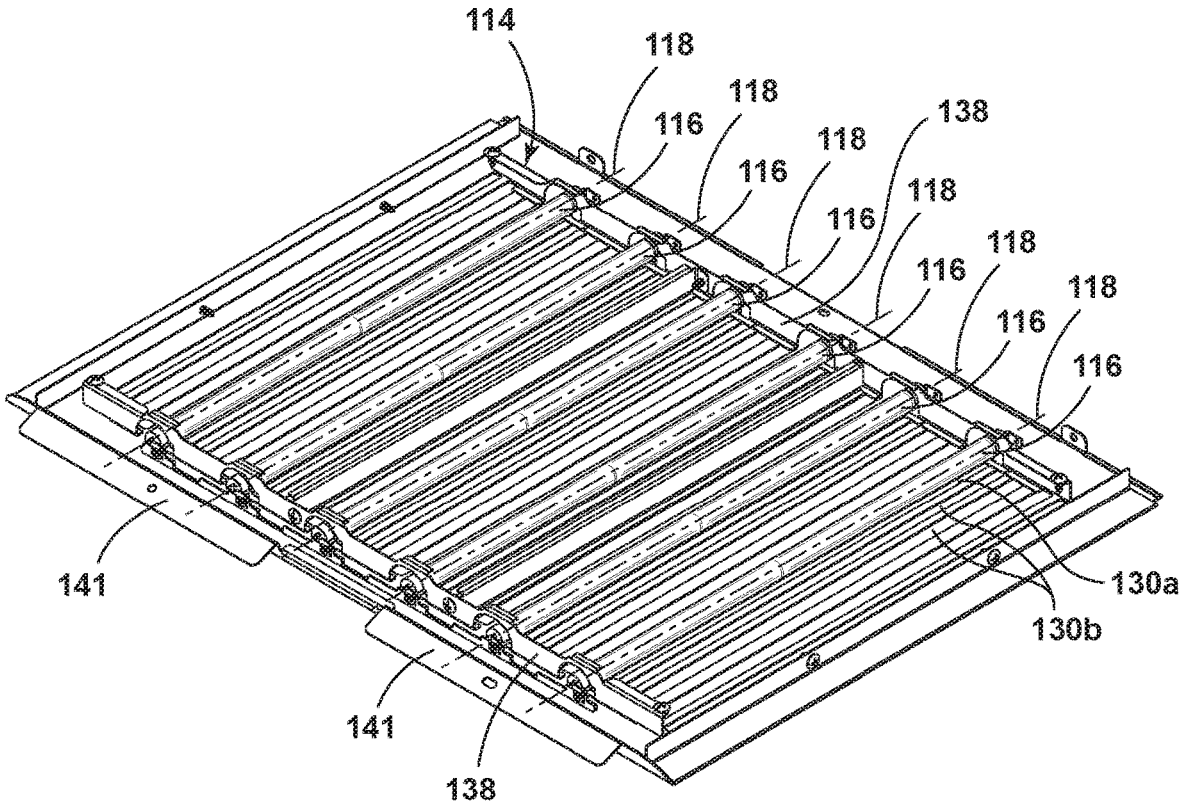
FIG. 11 is a top perspective view thereof.

Turning to the example shown in FIGS. 9-11, a cover unit 124 can be generally configured for use in a heating arrangement 110 configured as a broiler unit in a similar manner to the arrangement 10 discussed above and similarly having a heating assembly 114 that may include heating members 116 in the form of quartz tubes. As shown, in the present arrangement, the longitudinal axes 150 of the plurality of openings 130 extend in the depth direction 120 (i.e., parallel with the longitudinal axes 118 of the heating members 116). As further shown, the lengths 152 of the openings 130 can extend through substantially an entire depth 162 of the body 126 of cover unit 124. In one example, the lengths 152 of the openings 130 can be at least about 80% or about entire depth 162 of body 126. In a further aspect, the lengths 152 of the openings 130 can be at least about 95% of the lengths of the heating members 116 along the long axes 118 thereof.

As shown, the openings 130 can be distributed along the width direction 122 of the body 126 of the cover unit 124 such that only some of the openings **130*a* are aligned with respective ones of the heating members 116. Remaining ones of the openings 130*b* are positioned between adjacent ones of the elongate heating elements 116, including multiple ones of the openings 130*b* between each successive ones of the elongate heating elements 116. As discussed above, each of the openings 130 has a respective width 154 along the lateral axes 148 of the openings 130. The widths 154 of the openings 130*a* that are aligned with the elongate heating elements 116 are less than the widths 154 of the remaining ones of the openings 130***b*. In particular, the widths 154 of the openings 130*a* aligned with the elongate heating elements 116 are less than the widths 146 of the heating members 116. The widths 154 of the remaining, un-aligned openings 130*b* can increase successively with a distance away from the aligned openings 130*b* such that at least the particular openings 130*b* disposed farthest from the heating members 116 can have widths 154 greater than the widths 146 of the heating members 116. In various examples, the heating members 116 can have uniform widths 146 of between about 10 mm and about 20 mm, with the widths 146 in one particular example being about 12 mm. Further, the widths 154 of openings 130*a* can be about 5 mm, with the widths 154 of the remaining openings 130*b* being about 7 mm and about 10 mm, depending on the positioning with respect to openings 130*a*.

In the example of FIGS. 9-11, the openings 130*a* aligned with the heating members 116 have widths 154 that are less than the size of a human finger to, again, prevent contact with the heating members 116 through the openings 130. The greater widths 154 of the remaining openings 130*b* are possible because contact with the heating members 116 therethrough may be more difficult. The illustrated and described number and sizing of the openings 130*a*,130*b* can help to maximize the heating efficiency of the arrangement within the corresponding oven cavity, while providing acceptable protection for the heating members 116 and for a user.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A heating arrangement for an oven, comprising:

a heating assembly including a plurality of elongate heating members extending along respective longitudinal axes oriented in a first direction and mutually spaced apart in a second direction perpendicular to the first direction, the plurality of elongate heating members each having a width in the second direction; and a cover unit affixed with respect to the heating assembly and having a body extending along a plane oriented parallel with the plurality of elongate heating members, extending over an entirety of the plurality of elongate heating members in at least the first direction, and spaced apart therefrom in a third direction perpendicular to the first and second directions, a plurality of openings extending through the body and defining respective lateral axes and longitudinal axes longer than the lateral axes and extending in the first direction, each of the openings having respective lengths along the longitudinal axes that are greater than the width of the heating members and extending through substantially an entire depth of the cover in the first direction, the elongate heating elements being aligned with a single, respective one of the openings in the first and second directions.

2. The heating arrangement of claim 1, wherein the plurality of elongate heating members are discrete quartz tubes.

3. The heating arrangement of claim 1, wherein:

the plurality of elongate heating members have a width in the second direction; and the plurality of openings define respective lateral axes and longitudinal axes longer than the lateral axes, each of the openings having respective lengths along the longitudinal axes that are greater than the width of the heating members.

4. The heating arrangement of claim 1, wherein remaining ones of the openings are positioned between adjacent ones of the elongate heating elements.

5. The heating arrangement of claim 4, wherein:

each of the openings have respective widths along the lateral axes of the openings; and the widths of ones of the openings aligned with the elongate heating members are less than the widths of the remaining ones of the openings.

6. An oven, comprising:

a cabinet defining an interior cooking cavity; and a heating arrangement mounted within the interior cavity adjacent an upper surface thereof, the heating arrangement, including:

a heating assembly including a plurality of elongate heating members extending along respective longitudinal axes oriented in a first direction and having a width in a second direction perpendicular to the first direction; and a cover unit affixed with respect to the heating assembly and having a body extending along a plane oriented parallel with the upper surface of the cavity and spaced apart therefrom in a third direction with the heating members positioned between the upper surface and the cover unit, a plurality of openings extending through the body with at least some of the openings being aligned with respective ones of the elongate heating members in the first and second directions, the plurality of openings defining respective lateral axes and longitudinal axes longer than the lateral axes, the longitudinal axes of the plurality of openings extending in the second direction, all of the openings being arranged in respective rows with the longitudinal direction axes of the ones of the openings aligned in the second direction and in respective columns with the lateral axes of the ones of the openings from successive ones of the rows aligned in the first direction.

7. The oven of claim 6, wherein:

the aligned lateral axes of the openings in the respective columns are evenly spaced; and the plurality of elongate heating members have non-uniform spacing in the second direction characterized by the spacing between respective heating members decreasing away from a central one of the heating members.

8. The oven of claim 6, wherein the openings are arranged in respective rows with the longitudinal direction axes of the ones of the openings aligned in the second direction.

9. The oven of claim 8, wherein:

each of the openings have respective lengths along the longitudinal axes that are greater than the width of the heating members; and the openings are separated in the second direction by solid portions of the body that are positioned between adjacent ones of the plurality of elongate heating members.

10. An oven, comprising:

a cabinet defining an interior cooking cavity; and a heating arrangement mounted within the interior cavity adjacent an upper surface thereof, the heating arrangement, including:

a heating assembly including a plurality of elongate heating members extending along respective longitudinal axes oriented in a first direction and having a width in a second direction perpendicular to the first direction; and a cover unit affixed with respect to the heating assembly and having a body extending along a plane oriented parallel with the upper surface of the cavity, extending over an entirety of the plurality of elongate heating members in at least the first direction, and spaced apart therefrom in a third direction with the heating members positioned between the upper surface and the cover unit, a plurality of openings extending through the body with at least some of the openings being aligned with a single, respective one of the elongate heating members in the first and second directions, the plurality of openings defining respective lateral axes and longitudinal axes longer than the lateral axes, the longitudinal axes of the plurality of openings extending in the first direction, and the lengths of the openings extending through substantially an entire depth of the cover in the second direction.

11. The oven of claim 10, wherein remaining ones of the openings are positioned between adjacent ones of the elongate heating elements.

12. The oven of claim 11, wherein:

each of the openings have respective widths along the lateral axes of the openings; and the widths of ones of the openings aligned with the elongate heating elements are less than the widths of the remaining ones of the openings.

13. The oven of claim 12, wherein the widths of ones of the openings aligned with the elongate heating elements are less than the widths of the heating elements.

* * * * *